United States Patent [19]

Scherrer

[11] 4,188,776

[45] Feb. 19, 1980

[54] ELECTRONIC WATCH

[75] Inventor: Igor Scherrer, Colombier, Switzerland

[73] Assignee: Ebauches S.A., Neuchatel, Switzerland

[21] Appl. No.: 860,106

[22] Filed: Dec. 13, 1977

[30] Foreign Application Priority Data

Dec. 16, 1976 [CH] Switzerland ..... 15972/76

[51] Int. Cl.[2] ..... G04C 3/00; G04C 9/00

[52] U.S. Cl. ..... 58/23 R; 58/4 A; 58/38 R; 58/39.5; 58/50 R; 58/57.5; 58/58; 58/85.5

[58] Field of Search ..... 58/4 A, 23 R, 38 R, 58/39.5, 50 R, 57.5, 58, 74, 85.5

[56] References Cited

U.S. PATENT DOCUMENTS

| | | | |
|---|---|---|---|
| 3,988,597 | 10/1976 | Yamaguchi | 58/23 R X |
| 3,994,124 | 11/1976 | Fujita | 58/23 R |
| 4,045,952 | 9/1977 | Kashio | 58/23 R |
| 4,073,131 | 2/1978 | Takase et al. | 58/23 R |
| 4,092,822 | 6/1978 | Droz et al. | 58/23 R |
| 4,094,135 | 6/1978 | Nomura et al. | 58/23 R |
| 4,117,663 | 10/1978 | Mosimann et al. | 58/85.5 |
| 4,128,991 | 12/1978 | Robert-Grandpierre | 58/23 R |
| 4,142,361 | 3/1979 | Kimura | 58/50 R |

*Primary Examiner*—S. J. Witowski

*Attorney, Agent, or Firm*—Silverman, Cass & Singer, Ltd.

[57] ABSTRACT

A method and circuit for selecting a function of a watch. A predetermined number and a predetermined sequence of electrical code signals are user generated by two switches which are located on the watch. The code signals correspond to at least one function of the watch. The sequence of code signals is stored and the code signals occurring within a predetermined time period are counted. The count of the code signals occurring within the predetermined time period is compared to the predetermined number and the stored sequence of code signals are decoded only when the count of the code signals equals the predetermined number within the predetermined time period.

12 Claims, 7 Drawing Figures

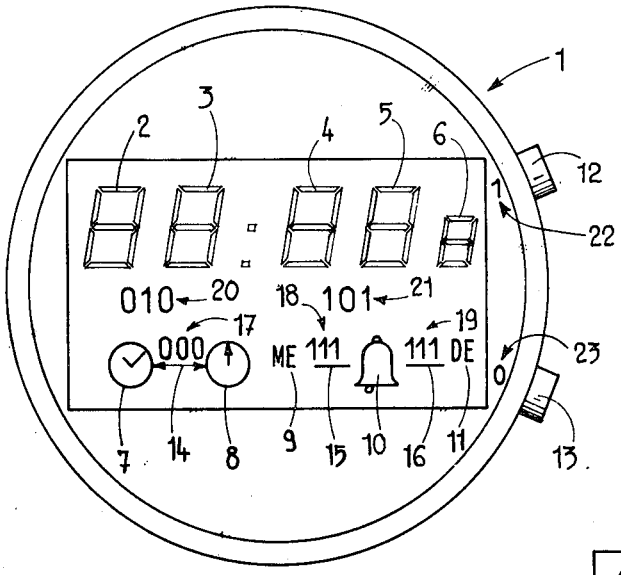
FIG. 1
FIG. 2
| 011 CORRECTION | |
|---|---|
| 010 H | 001 D |
| 101 Mn | 110 Mo |
| 100 S | 111 S/d |
| 000 WATCH | |
FIG. 4
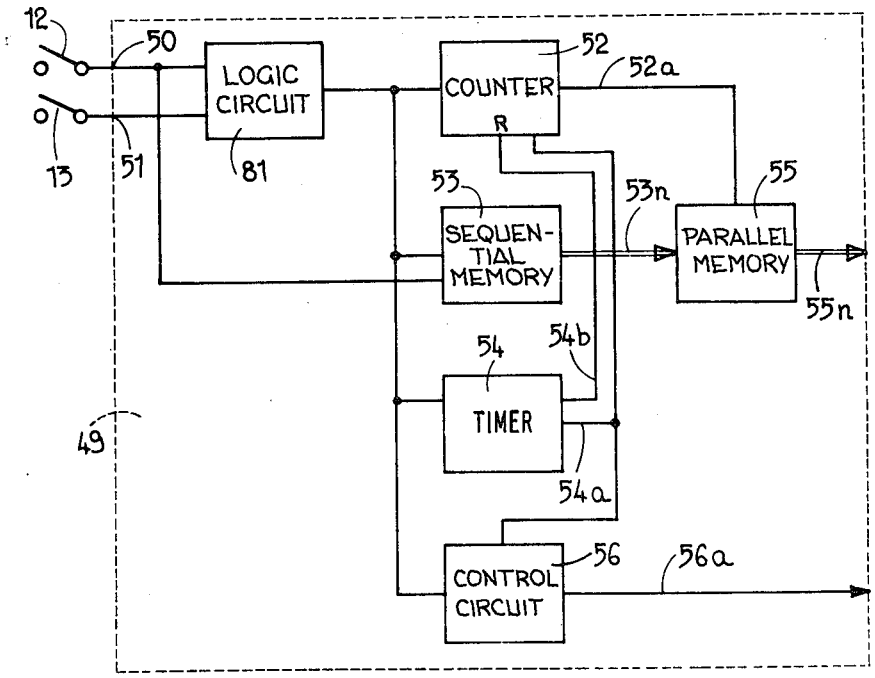

ELECTRONIC WATCH

The present invention relates to an electronic watch provided with two push button switches which control its several functions.

Most digital watches use a selector for correcting and setting the watch.

In spite of the fact that one attempts to explain the instructions for operating the functions of the watch, as simply and logically as possible, it is still difficult to explain them in a table or by indications which are sufficiently simple so that the instructions can be affixed on the dial or on the bottom of the casing of the watch.

An effort on the part of the user to memorize the instructions is consequently necessary for allowing the use of such digital watches, which effort becomes less convenient as the number of the functions which the watch can effect increases.

The purpose of the present invention is to remove this drawback by using a code, in principle arbitrary, for selecting operations of correcting and setting the watch. The operations can be made in any order, the code being chosen in such a way as being able to be reduced into a very simple instruction table.

The table must be single enough allow placing it on the bottom of the casing, or on the dial of the watch, in such a way that its availability at any time renders unnecessary the memorization of the instructions.

Two push button switches which are arbitrarily attributed code digits "0" and "1" respectively, are used to generate the code which, if it is suitably chosen, could be the same for all digital watches (LED, LCD with or without a lamp).

The watch according to the invention is characterized by the fact that it comprises a selecting and control circuit provided with at least two inputs connected each to one of the two push buttons. There are n outputs of selection with the sequence of output signals corresponding to at least one watch function and at least one control output. The selecting and control circuit is arranged in such a way that when the user has pressed p times on one of the push buttons and q times on the other one, in a time T beginning at the first pressure on one of the push buttons, with the succession or sequence of the pressures on the two push buttons being a given sequential code and the number of pushes $p+q$ being equal to n, then the n outputs of selection present, after the time T has lapsed, a combination of logic states comprising the generated sequential code formed by a succession of logic states 0 and of logic states 1 on the n outputs, which taken in their generated order, correspond to the said succession of the pressures on the said pushbuttons and to at least one selected function of the watch. When the user maintains a pressure on one of the push buttons after the time T, a control signal appears, at the end of the time T, on the said control output to effect the selected junction.

The drawing shows, by way of example, one embodiment of the object of the invention and two modifications.

FIG. 1 is a diagrammatic plane view of an electronic alarm and chronograph watch, having two control push button switches.

FIG. 2 is a table indicating the code digits it is necessary to effect by means of the said push button switches to have the watch of FIG. 1 execute its several functions.

FIG. 4 is a simplified block diagram of the selecting and control device of the watch.

Figure 3:
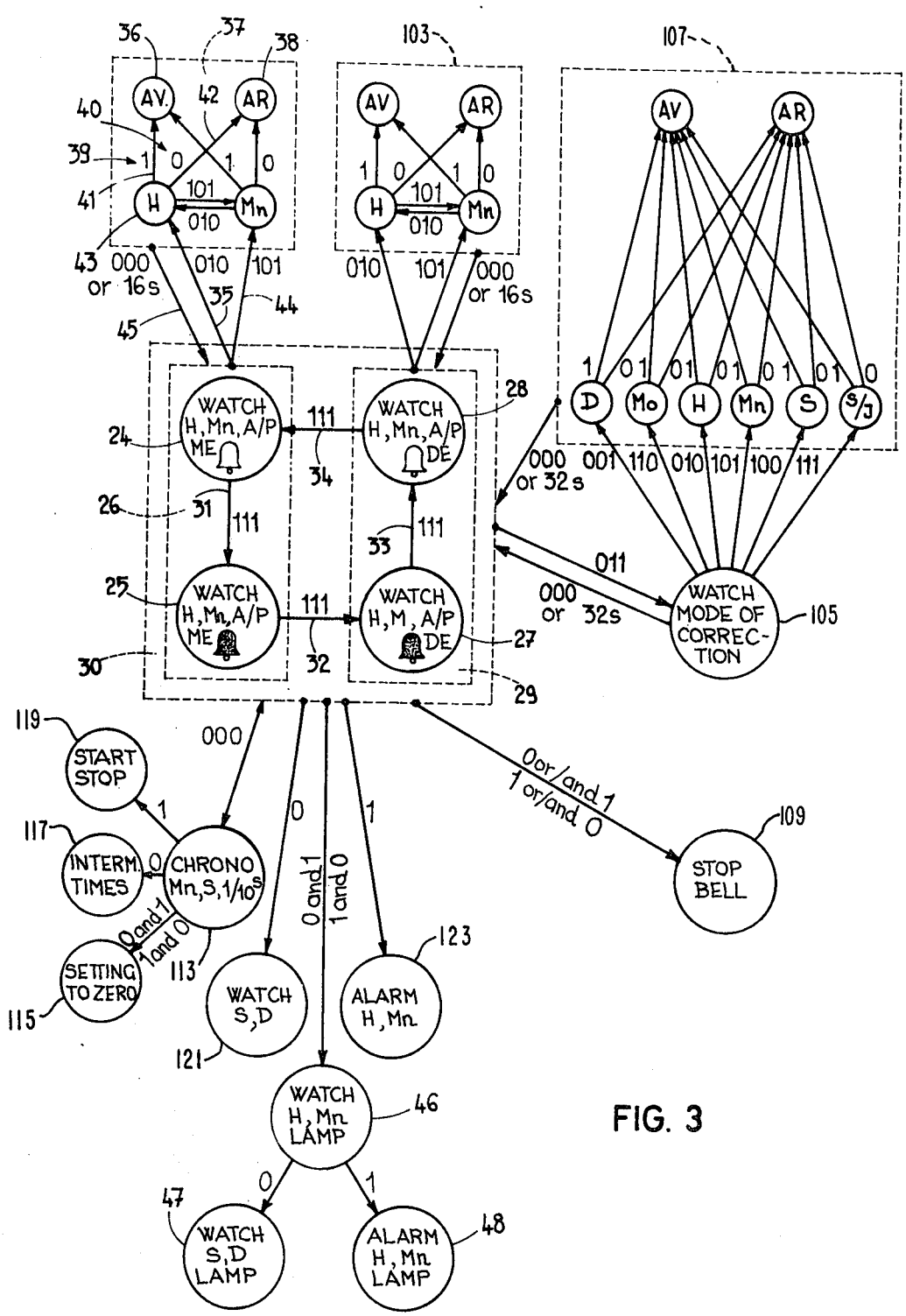
FIG. 3 is an operational diagram of the functions of the watch of FIG. 1 and of the way of controlling them.

The watch diagrammatically represented in FIG. 1 is generally designated by 1. It has four large digit indicators 2, 3, 4 and 5, a small digit indicator 6, and by five symbolic indicators 7, 8, 9, 10 and 11.

This watch comprises two push buttons for controlling its several functions, designated by 12 and 13, respectively. The said functions are enumerated in the course of the description which follows.

The four large indicators 2, 3, 4 and 5 indicate the hours and the minutes in normal operation as well as, on recall, the hour and the minute of the alarm function of the watch. In these two cases, the small indicator 6 displays the letters "A" or "P" according to whether the indicated time is before or after noon. The indicators 2 through 5 can indicate, on recall, the seconds and the date. In a chronograph mode, they indicate the minutes and the seconds with the indicator 6 indicating the tenths of seconds.

The two symbolic indicators 7 and 8 indicate, when they are activated respectively whether the watch is in normal operation or in chronograph mode.

The symbolic indicators 9, 10 and 11 indicate, by their combination, what mode of alarm the watch is in, these modes being:

Memory "ME", without bell, indicated by the activation of indicator 9 only.

Memory alarm "ME", with bell, indicated by the activation of indicators 9 and 10.

Counting alarm "DE", with bell, indicated by the activation of indicators 10 and 11.

Counting alarm "DE", without bell, indicated by the activation of indicator 11 only.

By "Memory alarm""ME" one understands here the usual mode of alarm where a bell in the watch strikes at a predetermined time; by "Counting alarm" "DE" one understands a mode where the bell strikes at the end of the period of time indicated by the alarm display (as in an automatic time-switch for the kitchen, for instance); so far as the two modes "ME" and "DE" without bell are concerned, they are provided for preventing the bell from striking when it is not desired.

The arrow 14 connecting the indicators 7 and 8, the lines 15 and 16 connecting the indicators 9 and 10 and 10 and 11 respectively, the groups 17, 18 and 19 of code digits "0" or "1" forming code words which accompany the arrows and lines, as well as the groups of code words 20 and 21, situated under indicators 2 through 5, are printed on the dial and are permanently visible, as are the code digits "1" and "0" indicated at 22 and 23, respectively, which are located near the push buttons 12 and 13. These code digits correspond to the most used codes and serve as a memorandum to the user.

The table of FIG. 2, which will preferably be printed on the bottom of the casing of the watch, but could also be printed on the dial, is a reminder for the user of how to correct the indicators of the watch, operations which are relatively rare.

FIG. 3 illustrates a flow chart for several operations which have to be effected to use the watch. The watch is normally in one of the states indicated by the circles 24 and 25 in block 26, and by the circles 27 and 28 in block 29, these two blocks 26 and 29 being in block 30. The watch will pass from one to the other of the states, cyclically, each time the user generates, for instance, the code word "111", indicated by arrows 31, 32, 33 and 34, by pressing on the push button 12 three times, in a period of less than two seconds.

Block 30 indicates the normal running state of the watch, which includes the states of blocks 26 and 29 and circles 24, 25, 27 and 28.

Block 26 indicates a state of the watch where the watch is in memory alarm "ME", with or without activating a bell. Block 29 indicates a state of the watch where the watch is in counting alarm "DE", with or without activating a bell.

Circle 24 indicates a state where the watch is indicating the hours "H", the minutes "Mn", AM or PM "A/P" and memory alarm "ME" without activating a bell. Circle 25 indicates a state where the watch is indicating the hours, minutes, AM or PM and memory alarm with activating a bell. Circle 27 indicates a state where the watch is indicating the hours, minutes, AM or PM and counting alarm "DE" with activating a bell. Circle 28 indicates a state where the watch is indicating the hours, minutes, AM or PM and counting alarm without activating a bell.

The modification of the time contained in the memory circuit for the memory alarm "ME" of the watch is obtained by starting from one of the states 24 or 25. Generating the code "010", indicated by the arrow 35, puts the watch into a state for correcting the hours which is indicated by the watch blanking out digits 4 and 5. In this state, a continuous pressure of at least two seconds on the push button 12 produces the running forwardly of the hour indication (circle 36, indicated "AV", of block 37) and a continuous pressure of at least two seconds on push button 13 produces the running backwards of the hours indication (circle 38 indicated "AR"). The reference numerals 39 and 40, designate the code digits "1" and "0", respectively, indicated near the arrows 41 and 42 connecting the circle 43 indicated by "H" to the circles 36 and 38 indicated "AV" and "Ar", respectively, and relate to the code digits "1" and "0", designated by reference numerals 22 and 23 in FIG. 1 near the push buttons 12 and 13 on the watch face. Generating the code "101", indicated by the arrow 44, puts the watch into a state for correcting the minutes "Mn" which is indicated by the watch blanking out digits 2 and 3. The correction of the minutes "Mn" indications is effected as has been disclosed hereinabove for the hours.

The code "000", indicated by the arrow 45, returns the watch into the state it had before the beginning of the correction. If, inadvertently, this code is not generated by the user, a timer causes the return 16 seconds, "16" of FIG. 3, after the last action on one of the push buttons.

The explanations of the other functions can be given similarly while following the indications of FIG. 1.

Modifying the hours and the minutes of the counting alarm "DE" and returning to the earlier state is performed as is shown in block 103. This generally is performed as has been described hereinabove for the memory alarm "ME", except that the codes for modifying the hours and minutes of the counting alarm first are generated while the watch is in the states indicated by circles 27 and 28.

Modifying each of the normal running functions of the watch such as the hour, minute and second functions is performed by generating the sequence of codes shown in FIG. 2. The watch is first put into a mode of correction shown by circle 105 of FIG. 3 by generating the code "011" when in the normal running state shown by block 30. Then generating one of the six codes shown in FIG. 2 and FIG. 3, selects one of the functions of the watch, shown in block 107, to modify one of the date "D" (code 001), the month "Mo" (code 110), the hour "H" (code 010), the minute "Mn" (code 101), the second "S" (code 100) and the running error in seconds per day "S/J" (code 111). These individual functions are advanced or reversed as has been hereinabove described by pressing on push buttons 12 and 13, respectively. Return to block 30 is performed by generating the code "000" or automatically, 32 seconds "32s", after the last operation on push button 12 or 13.

The sounding of the memory alarm or counting alarm bell in the watch is stopped as is shown at circle 109 of FIG. 3. As shown in FIG. 3, pressing any combination of push buttons 12 and 13 when the bell is sounding stops the sounding of the alarm bell.

The chronograph mode is entered by generating the code "000" on push button 13 when the watch is in the normal running mode of block 30. This is indicated at arrow 14 and code label 17 in FIG. 1 and is shown at circle 113 in FIG. 3. In the chronograph mode the watch indicates simultaneously the minutes "Mn", the seconds "S" and the tenths of seconds "1/10S". In the chronograph mode the watch may be operated as a stop watch. Actuating both push buttons 12 and 13 (code 0 and 1) sets the indicators to zero, circle 115. Actuating push button 13 (code 0) obtains interim times, circle 117. Actuating push button 12 (code 1) starts and stops the running of the stop watch. Return to normal running of the watch, block 30, again is obtained by generating the code word "000".

The seconds "S" and the date "D" of the watch may be displayed when the watch is in the normal running mode of block 30, as shown in circle 121, by generating the code "0" on push button 13. The seconds and date are displayed in place of the normal hour, minute and AM/PM of the watch indicators. Releasing push button 13 returns the watch to the normal running mode of block 30.

In a like manner, the hour "H" and the minute "Mn" of the respective alarm functions "ME" and "DE" may be displayed on the watch indicators when the watch is in the normal running mode of block 30. This is done by pressing push button 12 and generating the code "1" as shown by circle 123. When the code "1" is generated while the watch is in the mode of block 29, the hour and minute of the counting alarm "DE" are displayed. When the code "1" is generated while the watch is in the mode of block 26, the hours and minute of the memory alarm "ME" are displayed. Releasing push button 12 returns the watch to the normal running mode of block 30.

It can be noted that the switching on of a lamp to light the watch dial, indicated by the circles 46, 47 and 48, of FIG. 3 requires the simultaneous operation of the two push buttons 12 and 13. This arrangement, which may be considered unusual is made to prevent the lamp lighting untimely when one effects any other function of the watch, which has the advantage, which is not negligible, of saving electrical current. As a matter of fact, it is to be noted that the lamp itself uses 1,000 to 10,000 times more current than the rest of the watch. Consequently, each time the lamp is lit it substantially shortens the life of the battery, so that it is worthwile to provide means preventing any untimely lighting of the lamp.

One should note that, owing to the fact that the functions to be executed are selected by a code, one can select them in any order, which is not the case when the watch is provided with a sequential selector.

While referring to the simplified block diagram of the selecting and control device represented in FIG. 4, one sees that this device, generally designated by 49, comprises two inputs 50 and 51, connected respectively to the two push buttons 12 and 13. When the push buttons are at rest, the inputs 50 and 51 are at the logic state 0. If the push button 12 or 13 is operated, the corresponding input passes to the logic state 1.

The device 49 is composed of the following elements:

A logic circuit 81.

A counter 52 intended to count the number of pulses appearing at the inputs 50 and 51.

A register 53, or sequential memory, having n outputs indicated by the double arrow 53*n*, intended to record the succession of the pulses appearing at the inputs 50 and 51 in a way which will be disclosed hereinafter.

A timer 54 the output 54*a* of which delivers a logic signal 1 for a certain time T1 of about two seconds in the present example, after the arrival of a first pulse on 50 or on 51. At the end of time T1, the output 54*b* of the timer 54 delivers for a certain time T2, equal to about 125 milliseconds, a logic signal 1, which resets to zero the counter 52 through input R and the timer itself, internally which allows timer 54 to resume its timing function when as the next pulse arrives on 50 or 51.

It is to be noted that, when the number of pulses counted by the counter 52 reaches a predetermined value, which is 3 in the example disclosed and represented, and the output 54*a* of the timer 54 is in the logic state 1, then the output 52*a* of the counter 52 passes to the logic state 1.

A parallel memory 55, having n outputs indicated by the double arrow 55*n*, in FIG. 4, intended to store the state of the outputs of the register 53. The transfer of information occurs at the movement when the output 52*a* of the counter 52 passes to the logic state 1, that is to say when the predetermined number of pulses has been counted by the counter 52 during the time T1. After this transfer has occurred, the n outputs of the memory 55, shown as three outputs in FIG. 5, where they are indicated by 55*a*, 55*b* and 55*c*, are in the same logic state as the outputs of the register 53. It is to be noted that the n outputs of the memory 55 are connected to n outputs of the device 49.

A control circuit 56, having an output 56*a* which constitutes an output of the device 49, and which goes to the logic state 1 if, at the moment when the output 54*a* of the timer 54 passes to the logic state 1, the input 50 or input 51 is at the logic state 1. The output 56*a* of the control circuit 56 returns to the logic state 0 as soon as the input 50 or the input 51 passes to the logic state 0.

Figure 5:
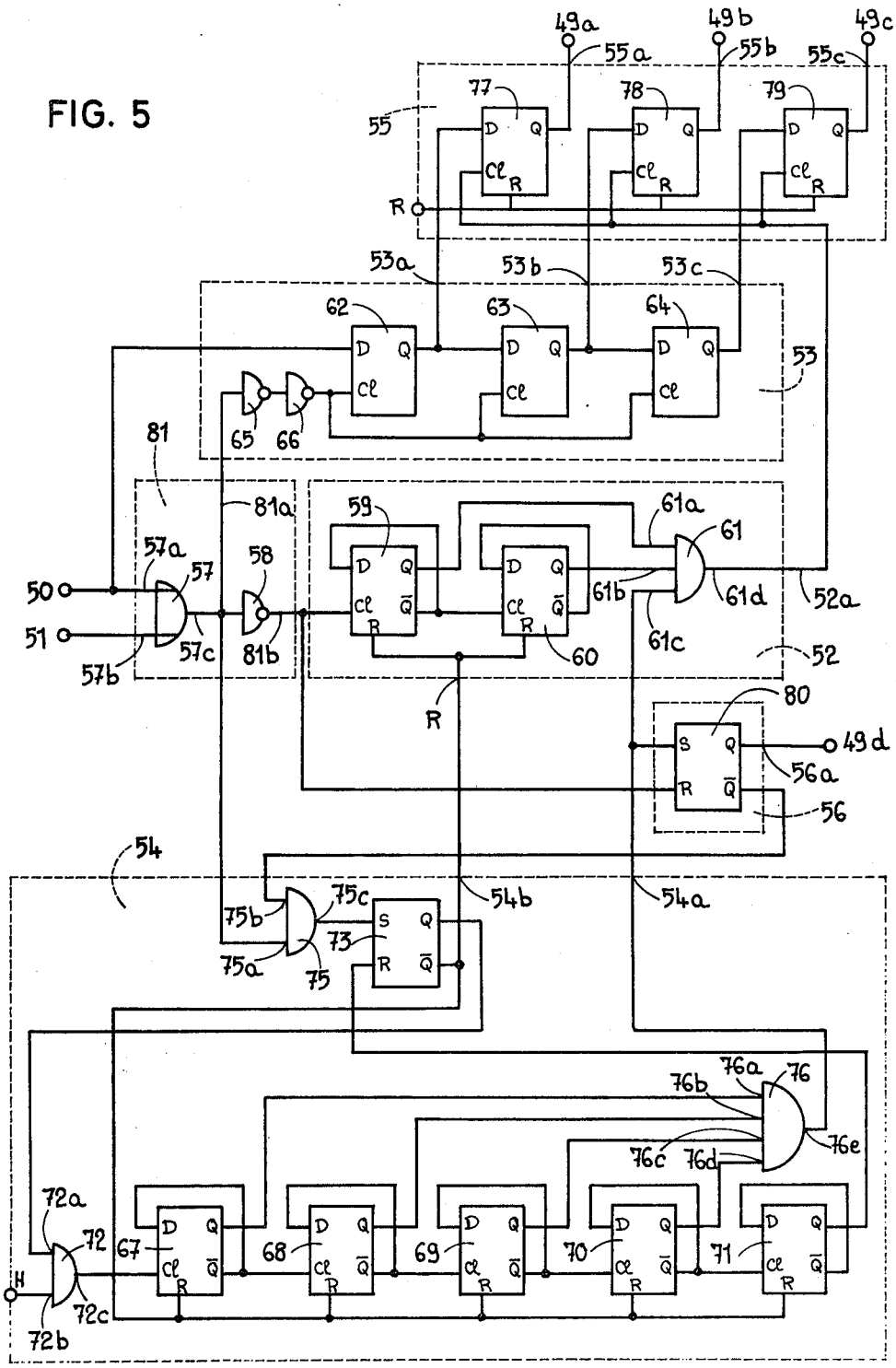
FIG. 5 is a more detailed diagram of an embodiment of the said selecting and control device.

A special embodiment, among many which are possible, of the selecting and control device 49 is represented in FIG. 5 in more detail, the several elements mentioned previously being indicated by the same symbols.

One finds in FIG. 5 the logic circuit 81 which comprises an OR gate 57 the inputs 57*a* and 57*b* of which are connected to the inputs 50 and 51, respectively, of the device. Its output, which is simple in FIG. 4, is here composed of a direct output 81*a* and of an output 81*b* inverted by the inverter 58. This is only due to the choice of the other circuits used in this example, and does not change the logic explanation.

The counter 52 comprises two D type flip flops 59 and 60, the outputs $\overline{Q}$ of which are connected, respectively, to their inputs D. The input Cl of the flip flop 59 is connected to the output 81*b* of the circuit 81 and its output $\overline{Q}$ is also connected to the input Cl of the flip flop 60. The outputs Q of these two flip flop are connected to the first inputs 61*a* and 61*b*, respectively, of an AND gate 61 having three inputs, the output 61*d* of which is connected to the output 52*a* of the counter 52.

The register 53 is composed of three D type flip flops 62, 63 and 64, the inputs Cl of which are connected between themselves and, through two inverters 65 and 66, to the output 81*a* of the logic circuit 81. The output Q of the flip flop 62 is connected to the input D of the flip flop 63 and to the output 53*a* of the register 53, the output Q of the flip flop 63 is connected to the input D of the flip flop 64 and to the output 53*b* of the register 53, and the output Q of the flip flop 64 is connected to the output 53*c* of the register 53. The input D of the flip flop 62 is connected to the input 50 of the device 49.

The timer 54 is constituted principally of flip flop 67 through 71, the outputs $\overline{Q}$ of which are connected to their own inputs D and, for the flip flop 67 to 70, to the input Cl of the FF of the number immediately higher. The input Cl of the flip flop 67 is connected to the output 72*c* of AND gate 72 the input 72*a* of which is connected to the output Q of an RS type flip flop RS 73, while its input 72*b* is connected to an input H of the timer which receives pulses of a frequency of 8 Hz delivered by the frequency divider of the watch indicated at 74 in FIG. 7. The output $\overline{Q}$ of the flip flop 73 is connected to the reset to zero input R of the flip flop 67 through 71, and, by the output 54*b* of the timer 54 and the input R of the counter 52, to the reset to zero input R of flip flop 59 and 60. The input R of the flip flop 73 is connected to the output Q of the flip flop 71 and its input S is connected to the output 75*c* of an AND gate 75, an input 75*a* of which is connected to the output 81*a* of the logic circuit 81. The timer 54 comprises moreover an AND gate 76 the four inputs 76*a* through 76*d* of which are connected, respectively, to the output Q of flip flop 67 to through 70, and the output 76*e* is connected to the third input 61*c* of the AND gate 61.

The memory 55 comprises three D type flip flops 77, 78 and 79, the inputs D of which are connected to the outputs 53*a*, 53*b* and 53*c*, respectively, of the register 53, and the inputs Cl of which are connected between themselves and to the output 61*d* of the AND gate 61. The outputs Q of flip flops 77, 78 and 79 are connected, respectively, to the outputs 55*a*, 55*b* and 55*c* of the memory 55 and, consequently, to the outputs 49*a*, 49*b* and 49*c* of the device.

The reset to zero inputs R of flip flop 77 through 79 are connected between themselves and with an input R of the memory 55.

The control circuit 56 is limited to a RS type flip flop 80 the input S of which is connected to the output 76*e* of the AND gate 76, the input R of which is connected to the output 81*b* of the logic circuit 81, the output $\overline{Q}$ to the input 75*b* of the AND gate 75 and the output Q, by the intermediary of the output 56*a* of the control circuit, to the output 49*d* of the device 49.

The operation of the device 49 is described as follows:

At rest, the input Cl of the flip flop 59 is at the logic state 1. This results when the inputs 50 and 51 being at the logic state 0, which inputs control the inputs 57*a* and 57*b* of the OR gate 57 and, consequently, its output 57*c* which further control the input of the inverter 58. When the user presses for the first time on one of the push buttons 12 or 13, the logic state 1 which results therefrom reaches the output 57*c* of the Or gate 57. The input Cl of the flip flop 59 passes then to the logic state 0, which has no effect on this flip flop. This same logic signal 1 passes through the AND gate 75, since the output Q of the flip flop 80 is in the logic state 1. Consequently, the output Q of the flip flop 73 passes to the logic state 1 (its input R is at the logic state 0, since the output Q of the flip flop 71 is at the logic state 0). Consequently, the input 72*a* of the AND gate 72 passes also to the logic state 1, which permits the pulses arriving on the input H of the device 49, the frequency of which, as it has been said, is 8 Hz, to reach the output 72*c* of the AND gate 72. Simultaneously, the inputs R of flip flops 67 through 71 pass to the logic state 0, which permits the counter constituted by these flip flop to start counting these pulses. At the arrival of the 15th pulse after the opening of the AND gate 72, the outputs Q of flip flop 67 through 70 are at, or pass to the logic state 1. Consequently, a logic signal 1 appears at the output 76*e* of the AND gate 76. At the beginning of the 16th pulse, the outputs Q of flip flop 67 through 70 pass to the logic state 0, which resets to the logic state 0 the output 76*e*, with the output Q of the flip flop 73 passing simultaneously to the logic state 1. The effect of these signals will be explained later.

If the first pressure mentioned hereinabove has been a pressure on the push button 12, a logic signal 1 is presented to the input D of the flip flop 62. Another logic signal 1, coming from the output 57*c* of the OR gate 57, appears on the inputs Cl of flip flops 62, 63 and 64, with a small delay due to the propagation time in the OR gate 57 and in the inverters 65 and 66. This delay is sufficiently long enough so that the logic signal 1 arriving on the input D of the flip flop 62 can be transmitted correctly to its output Q. Simultaneously, the preceding state of the output Q of the flip flop 62 is transmitted to the output of the flip flop 63 and the state of the output Q of the flip flop 63 is transmitted to the output Q of the flip flop 64, these signals having however no importance at this moment.

If, on the other hand, the first pressure has been exerted on the push button 13, it is the logic state 0 which is presented to the input D of the flip flop 62 at the moment when the pulse arrives on the input Cl of the flip flop 62, 63 and 64. Consequently, it is this logic state 0 which is, in this case, transmitted to the output Q of the flip flop 62.

At the moment when the user releases the pressure on the selected push button 12 or 13 he has operated, the output 57*c* of the OR gate 57 returns to the logic state 0, which has no effect on flip flops 62 and 73. However, the input Cl of the flip flop 59 passes from the logic state 0 to the logic state 1, which makes its output Q pass to the logic state 1. Consequently, the counter 52 has counted one pulse.

The hereinabove mentioned process is repeated when the user presses a second time on one of the push buttons 12 or 13, provided the timer 54 has not, in the meantime, had the time to count 15 pulses, that is to say provided that less than about two seconds have passed since the first pressure on one of the push buttons has been effected. The logic signal 1 or 0, which appeared at the output Q of the flip flop 62 after the first pressure, is transferred to the output Q of the flip flop 63 and is replaced by a logic signal 1, if it was the push button 12 which was operated, and by a logic signal 0 if it was the push button 13.

At the end of the second pressure, the output Q of the flip flop 59 returns to the logic state 0 and the output Q of the flip flop 60 passes to the logic state 1. Consequently, the counter 52 has counted two pulses.

The same process occurs once more when the user presses a third time on one or the other of the push buttons. The signal present on the output Q of the flip flop 63, which corresponds to the first pressure on one of the push buttons, is transferred to the output Q of the flip flop 64; the signal which was present on the output Q of the flip flop 62, which corresponds to the second pressure, is transferred to the output Q of the flip flop 63, and the new signal, corresponding to the third pressure, appears on the output Q of the flip flop 62.

At the end of this third pressure, the output Q of the flip flop 59 passes to the logic state 1, and the counter 52 indicates then that three pressures on the push buttons have been effected. The inputs 61*a* and 61*b* of the AND gate 61 are consequently at the logic state 1.

While the user was effecting these three pressures, the timer 54 was continuing to count the pulses arriving on the input H of the device 49. At the 15th pulse, as it has been disclosed hereinabove, a logic signal 1 appears at the output 76*e* of the AND gate 76. This signal is found again at the input 61*c* of the AND gate 61, the two other inputs of which, as it has been disclosed, are already at the logic state 1. Consequently, a logic signal 1 appears at the output 61*d* of the AND gate 61 and, consequently, at the inputs Cl of the flip flop 77, 78 and 79. The code information bits "0" or "1" which at this time are at the outputs Q of flip flop 62, 63 and 64 are consequently transmitted, respectively, to the outputs Q of the flip flops 77, 78 and 79 and, consequently, to the outputs 55*a*, 55*b* and 55*c* of the memory 55 and to the outputs 49*a*, 49*b* and 49*c* of the device 49.

The logic signal 1 delivered by the output 76*e* of the AND gate 76 appears also on the input S of the flip flop 80; but since neither the push button 12 nor 13 are operated at this moment, the input R of this flip flop 80 is also at the logic state 1, so that its output Q remains at the logic state 0.

At the beginning of the 16th pulse arriving on the input H of the device 49, the outputs Q of flip flops 67 through 70 pass again simultaneously to the logic state 0, which resets also to the logic state 0 the output 76*e* of the AND gate 76 and, consequently, the output 61*d* of the AND gate 61. The output Q of the flip flop 71 passes to the logic state 1, which produces a changing of states of the flip flop 73 the output Q of which returns to the logic state 0; Consequently, the pulses arriving on the input H can no longer pass through the AND gate 72. The output $\overline{Q}$ of the flip flop 73 passes to the logic state 1, which produces the resetting to zero of the flip flop 71, the output Q of which remains consequently at the logic state 1 only a very short time (the other flip flop through 70 of the timer 54 are already at the logic state 0 at this time), as well as the resetting to zero of flip flops 59 and 60 of the counter 52.

The process of selection of the function to be effected is now ended. The combination of the logic states present at the outputs 49*a*, 49*b* and 49*c* of the device 49 corresponds to the succession of the pressures caused by the user on the push buttons 12 and 13, the state corresponding to the first pressure being on the output 49*c* and the state corresponding to the third pressure being on the output 49*a*.

When the user wants to execute the function he has just selected, he presses once more on one or the other of the push buttons 12 and 13. The content of the register 53 changes, as it has been disclosed hereinabove, but it has no importance since the useful information is stored in the memory 55 the content of which is not modified.

At the instant of this fourth pressure, the flip flop 73 changes state again, as it did at the first pressure, and its output Q passes to the logic state 1, which opens the AND gate 72 which passes the pulses arriving on the input H. The timer 54 consequently starts to count them again. If the user maintains his pressure on the push button 12 or 13 until 15 pulses have been counted, that is to say for about two seconds, the signal which appears then at the output 76*e* of the AND gate 76 can bring the flip flop 80 to change its state; a logic signal 1 is present at the output 57*c* of the OR gate 57, since the push button 12 or 13 is operated, and a logic signal 0 is consequently on the input R of the flip flop 80. The logic signal 1 which appears then at the output Q of this flip flop 80 and, consequently, at the output 49*d* of the device 49 can be used for controlling the execution of a preselected function, for instance as has been disclosed previously.

When the 16th pulse after the pressure on the push button 12 or 13 arrives the input H, the outputs Q of flip flops 67 through 70 return to the logic state 0 and the output Q of the flip flop 71 passes to the logic state 1. As explained hereinabove, the input R of the flip flop 73 receives this logic signal 1, which changes its state again. The input S of flip flop 73 is, as a matter of fact, now at the logic state 0 due to the logic signal 0 delivered by the output $\overline{Q}$ of the flip fop 80 which disables the AND gate 75 by its input 75*b* and which, consequently, prevents the logic signal 1 coming from the output 57*c* of the OR gate 57 from reaching the input S of the flip flop 73. Consequently, the AND gate 72 is disabled and the flip flop 71 is reset to zero. This state is maintained as long the user presses on one of the push buttons 12 or 13, and the selected function continues to be effected.

When the user releases the push button he was pressing, the output 57*c* of the OR gate 57 passes again to the logic state 0 and the input R of the flip flop 80 receives a logic signal 1. The output Q of the flip flop 80, and consequently the output 49*d* of the device 49, pass to the logic state 0.

If the user wants the function to continue to be executed, he presses again on the push button 12 or 13. The process as disclosed hereinabove starts again and, after a time of about two seconds, the output 49*d* resumes the logic state 1.

If the user wants another function to be executed, he presses the push button 12 and/or 13 according to another order or code, in a period less than two seconds. The outputs 49*a*, 49*b* and 49*c* of the device 49 then take a new state corresponding to this new function. After this selection, the user presses again on the push button 12 or 13 for more than two seconds for executing the newly selected function.

If, for any reason, the user does not press three times on the push button 12 or 13 during the two seconds following the first pressure, the state of the outputs 49*a*, 49*b* and 49*c* is not modified. As a matter of fact, at the moment when the logic signal 1 appears at the output 76*e* of the AND gate 76 and, consequently, at the input 61*c* of the AND gate 61, one of the two other inputs of AND gate 61 are still at the logic state 0. The inputs Cl of flip flops 77, 78 and 79 do not receive any logic signal 1, and these flip flops remain in their preceding state. When the output Q of the flip flop 71 passes to the logic state 1, as it has been disclosed hereinabove, the flip flop 73 changes state again, bringing flip flops 59, 60 and 71 to the logic state 0. The device is then again in its rest condition.

When some function has been selected, the input R of the memory 55 receives, from a circuit not shown, a reset to zero signal some time (32 seconds, "32s" for instance see FIG. 3) after the last pressure on one of the push buttons. This signal resets to zero the three outputs Q of flip flop 77 through 79, and consequently the outputs 49*a* to 49*c* of the device, which prevents any wrong manipulations of selected functions, in the case where, for instance, the user would forget to select or generate the return code 000 after selecting a function.

Figure 6:
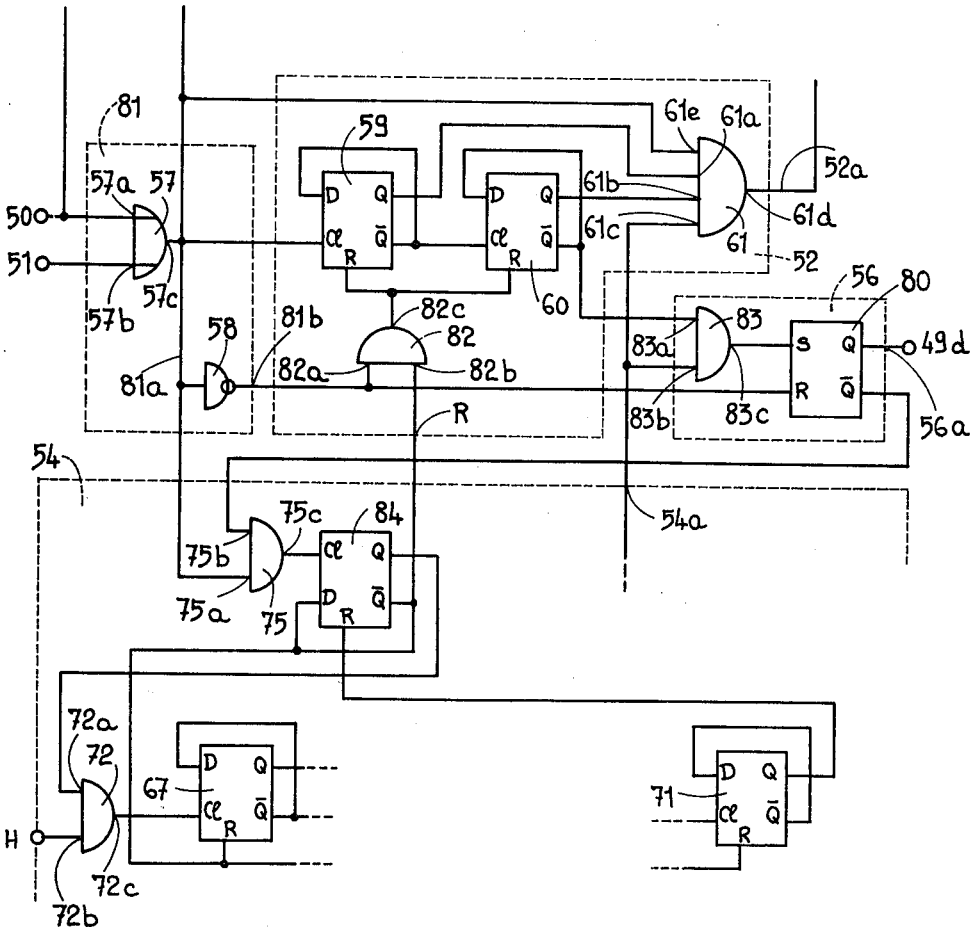
FIG. 6 is a partial diagram of a modification of the selecting and control device.

In a modification of the selecting and control device illustrated in FIG. 6, the counter 52, the control circuit 56 and the timer 54 are slightly modified with respect to FIG. 5 : The input Cl of the flip flop 59 is directly connected to the output 57*c* of the OR gate 57. The inputs R of flip flops 59 and 60 are connected to the output 82*c* of an AND gate 82 the inputs 82*a* and 82*b* of which are connected, respectively, to the output 81*b* of the logic circuit 81 and to the input R of the counter 51. The AND gate 61 comprises a fourth input 61*e*, connected to the output 81*a* of the logic circuit 81. The input S of the flip flop 80 is connected to the output 83*c* of an AND gate 83 the inputs 83*a* and 83*b* of which are connected, respectively, to the output Q of the flip flop 60 and to the output 54*a* of the timer 54. The RS type flip flop 73 is replaced by a D type flip fop 84 the input Cl of which is connected to the output 75*c* of the AND gate 75, and the input D of which is connected to its own output Q which is also connected to the inputs R of the counter 52 and of flip flops 67 through 71, the reset to zero input R of which is connected to the output Q of the flip flop 71, and the output Q of which is connected to the input 72*a* of the AND gate 72.

With this configuration, the operation of the circuit is the following : The first pressure on one of the push buttons 12 or 13 produces the changing of the state of the flip flop 84, which permits the pulses arriving at the input H to reach the input Cl of the flip flop 67 and, consequently, the timer 54 starts counting.

The flip flip 59 rocks immediately (while with the configuration of FIG. 5 it changed state only at the end of the first pressure), its input R being put to the logic state 0 by the changing of state of flip flop 84.

The counter constituted by flip flops 59 and 60 counts, as previously, the three successive pressures on the push buttons 12 or 13 and the storing of the information in flip flops 62 through 64 occurs exactly in the same way as hereinabove described. At the third pressure however, the user must keep his finger on the push button, to maintain the input 61*e* of the AND gate 61 at the logic state 1. Thus, when the output 54*a* of the timer 54 delivers its signal, the four inputs of the AND gate 61 are at the logic state 1, and the output 61*d* delivers the pulse which effects the transfer of the information from the outputs 53*a* to 53*c* of the register 53 to the outputs 49*a* to 49*c* of the device.

When the flip flop 71 changes state in its turn, the flip flop 84 resumes its rest position, in spite of the fact that its input Cl is still at the logic state 1. The flip flop 59 and 60 are however not reset to zero, since the signal 0 present at the output 81*b* of the circuit 81 prevents the logic state 1 of the output $\overline{Q}$ of flip flop 84 from reaching their input R. This last logic state 1 resets the flip flop 67 through 71 to 0 and the AND gate 72 receives on its input 72*a* a signal 0 which prevents the passage of the pulses arriving on the input H.

The flip flop 80 does not change states at this moment, since the signal 0 present on the output $\overline{Q}$ of the flip flop 60 prevents the pulse delivered by the output 54*a* of the timer 54 from reaching its input S.

When the user releases the push button he was maintaining pressed, a signal 1 appears at the input 82*a* of the AND gate 82, which allows the reset of flip flops 59 and 60. When the user presses again on one of the push buttons for executing the function he has just selected, and if he maintains his pressure, the timer 54 starts again, as hereinabove explained, counting the pulses arriving on the input H, and the output 54*a* delivers, about two seconds later, its signal 1. As the user has pressed only once the push button, the output Q of the flip flop 60 is still at the logic state 1. Consequently, this signal delivered by the output 54*a* of the timer 54 cannot pass the AND gate 61, but it brings the flip flop 80 to change states. Consequently, the output 49*d* of the device passes to the logic state 1, which switches on the function which has been selected. The circuit remains in this condition until the user releases the push button.

With this configuration, the reliability of operation is increased with respect to the embodiment of FIG. 5.

In the example as disclosed, eight functions at the maximum can be selected. However this number is not limiting, since it is only necessary to increase the number of flip flops of the register 53 and of the memory 55 and to adapt the counter 52 to enable it to select a higher number of functions with codes having more than three digits.

One could also imagine a selection and control circuit where some codes would serve to operate a switching circuit so as to modify the purpose of the codes which are later introduced. One sees the use of such a code as listed in FIG. 2 and as shown in the flow diagram of FIG. 3. The preliminary introduction of the 011, for instance, puts the watch a mode of correction, so that the introduction of the code word 010 allows one to correct the counter of the "H" of the watch. Without this preliminary introduction, the later code word would have operated to modify the content of the memory of the alarm time.

Figure 7:
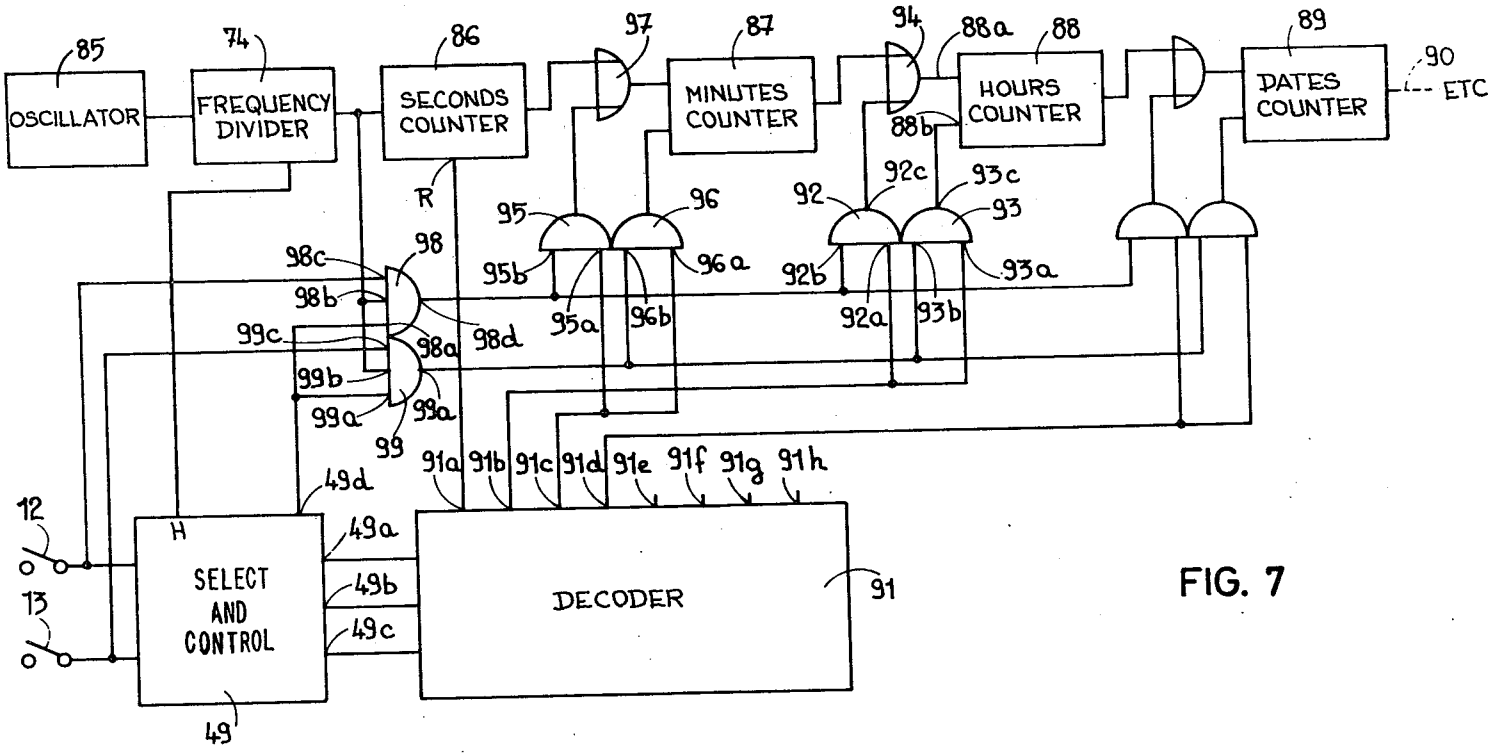
FIG. 7 is a block diagram of the electronic circuit of the watch, illustrating its connections with the circuit of the selecting and control device.

FIG. 7 discloses a watch which constructed more simply than the one of FIG. 1, the circuit of which comprises an oscillator 85, for instance a quartz oscillator, the frequency divider 74 previously mentioned, and four counters 86, 87, 88 and 89, respectively of seconds, of minutes, of hours and of the dates. The number of these counters could be higher, as indicated by the dashed line 90.

The outputs 49*a*, 49*b* and 49*c* of the device 49 are connected to the inputs of a decoder 91 the outputs 91*a* through 91*h* of which are connected, respectively, to the several circuits of the watch. For instance, the output 91*a* is connected to a reset to zero input R of seconds counter 86, the output 91*b* is connected to the inputs 92*a* and 93*a* of two AND gates 92 and 93 the outputs 92*c* and 93*c* of which cause respectively the increment input 88*a* of the hours counter 88 through an OR gate 94 and the decrement input 88*b* of the same counter 88. The output 91*c* is connected, in the same way, to the increment and decrement inputs of the minutes counter 87, through gates 95, 96 and 97.

The output 49*d* of the device 49 is connected to the inputs 98*a* and 99*a* of two AND gates 98 and 99, the second inputs 98*b* and 99*b*, respectively, of which are connected to the frequency divider 74 of the watch so as to receive pulses at a frequency of 1 Hz for instance. The AND gate 98 and 99 have a third 98*c* inputs, respectively, which are connected to the push buttons 12 and 13, respectively. The output 98*d* of the AND gate 98 is connected to the inputs 92*b* and 95*b* of the AND gate 92 and 95. So far as the output 99*d* of the AND gate 99 is concerned, it is connected to the inputs 93*b* and 96*b* of the AND gates 93 and 96.

In this example, the operation of the watch is the following so far as its correction operation is concerned:

Push buttons 12 and 13 are designated on the watch face in their vicinity, as hereinabove disclosed, by the symbols 22 and 23, code digits "1" and "0", respectively. The user can, while considering the instructions of the table represented in FIG. 2, determine that he must operate once the push button 13 designated code digit "0", then operates once the push button 12 designated code digit "1", then once more operates the push button 13 for selecting the function "H" "correction of the hour". After this manipulation of the watch, and provided it has been performed in a time of less than two seconds, the outputs 49*a*, 49*b* and 49*c* of the device !present, respectively, the logic states 0, 1 and 0, where the two "0" digits correspond to the two pressures on the push button 13 and the single "1" digit corresponds to the pressure on the push button 12.

The decoder 91 is arranged, in a known manner, in such a way that, with this combination of logic states on its inputs, its output 91*b* presents a logic state 1, while all its other outputs are at the logic state 0. Consequently, the input 92*a* of the AND gate 92 is also at the logic state 1. If the user wants to increment the hours counter, he then presses on the push button 12, continuously. After about two seconds, a logic signal 1 appears on the output 49*d* of the device 49. Consequently, the inputs 98*a* and 98*c* of the AND gate 98 are at the logic state 1, which permits the pulses arriving on the input 98*b* of this gate to pass to the input 92*b* of the AND gate 92. Since the input 92*a* of this gate is at the logic state 1, these pulses are applied, through the OR gate 94, which is the increment input 88*a* of the hours counter 88. The content of this counter increments one unit each second so long as the user maintains pressure on the push button 12.

If the user wants the hours counter 88 to decrement, he presses the push button 13 after having made the selection of the function "correction of the hour". When, as hereinabove disclosed, the output 49*d* of the device 49 passes to the logic state 1, it is the AND gate 99 which lets pass the pulses which are then applied to the input 88*b* of the counter 88, through the AND gate 93. Consequently, the content of the counter 88 decrements one unit per each second so long as the user maintains the pressure on the push button 13.

If the user wants to execute another function, for instance the correction of the date, he presses, always after having considered the instruction table of FIG. 2, twice on the push button 13 and once on the push button 12. Two seconds after the first pressure, the outputs 49*a*, 49*b* and 49*c* of the device 49 take the logic states 1, 0, 0, respectively, and the output 91*d* of the decoder 91 takes the logic state 1. In this state, the correction of the dates counter 89 occurs by acting on the push button 12 to produce an advance or, by acting on the push button 13, to produce a retard of the date as displayed. The correction of the minutes counter 87 is effected the same way, after the selection of the combination "101", which produces a logic signal 1 on the output 91*c* of the decoder 91. The signals for advancing or for retarding the display are then produced, when the push button 12 or 13 is operated, by the intermediary of the gates 98, 95 and 97 or 99 and 96.

Other functions can be selected and controlled the same way, the circuit of FIG. 7 giving only one example of the numerous possibilities of using the device 49.

The advantages of the watch as disclosed and represented are especially the following :

Use of two control push buttons only, whatever the number of functions which are able to be effected by the watch are.

Due to the fact that it constitutes a lock against any untimely manipulation, the coding permits one to use mechanical push buttons, which are visible, as well as electrostatic push buttons.

Possibility of representing most of the modes of use of the watch in a simple table, small enough to appear on the watch itself.

Great flexibility in the selection of the junctions, the selections being able to be effected in an arbitrary order.

Besides the selection code, the other manipulations are very simple and natural : "1" for advancing, "0" for retarding a correction mode.

Possibility of adopting similar manipulations for all the dimensions of movements.

Other functions like chronograph, fine correction of play, correction of the running by inhibition, rapid code for tests in production, etc., can also be easily added.

What I claim is:

1. A method of selecting a function of a watch, said method comprising:

producing a predetermined number and a predetermined sequence of electrical code signals, said number and sequence of code signals corresponding to at least one watch function;

storing said sequence of code signals;

counting said code signals which are produced within a predetermined time period;

comparing said count of said code signals with said predetermined number; and decoding said stored sequence of code signals when said count of said code signals equals said predetermined number within said time period.

2. A method as claimed in claim 1 in which producing said code signals includes generating at least one of a first and a second code signal.

3. A method as claimed in claim 1 further including producing at least one electrical control signal by producing at least one of said code signals after said predetermined time period to enable said decoding and to effect said selected function.

4. A method as claimed in claim 3 in which producing said control signal includes generating said control signal for a period of time longer than said predetermined time period.

5. A method as claimed in claim 4 in which generating said control signal includes forming one of a first and a second control signal.

6. A method as claimed in claim 4 in which generating said control signal includes forming a first and a second control signal.

7. A method as claimed in claim 5 in which forming said first control signal includes advancing said selected function.

8. A method as claimed in claim 5 in which forming said second control signal includes reversing said selected function.

9. An electrical circuit for selecting a function of a watch, said circuit comprising:

switch means for producing a predetermined number and a predetermined sequence of electrical code signals, said number and said sequence of said code signals corresponding to at least one watch function;

memory means coupled to said switch means for storing said sequence of said code signals;

timer means coupled to said switch means for producing a timing signal for a predetermined time period, said period commencing with the beginning of said code signals;

counter means coupled to said switch means and said timing signal for counting said code signals produced within said predetermined time period, and for comparing said count of said code signals with said predetermined number; and decoder means coupled to said memory meand and said counter means for decoding said stored sequence of code signals when said count of said code signals equals said predetermined number within said time period.

10. A circuit as claimed in claim 9 in which said switch means are two switches and each switch is actuated to produce one code signal.

11. A circuit as claimed in claim 9 in which said memory means are sequential memory means coupled to said switch means for sequentially storing said sequence of code signals, and second memory means coupled to said sequential memory means and said counter means for storing said sequence of code signals in parallel at the end of said time period when said count of said code signals equals said predetermined number during said time period.

12. A circuit as claimed in claim 9 further including control means coupled to said switch means, said timing signal and said decoder means for enabling said decoder means and for effecting said selected function in response to a control signal generated by said switch means after said predetermined time period.

* * * * *